US008408190B2

(12) United States Patent
Spix et al.

(10) Patent No.: US 8,408,190 B2
(45) Date of Patent: Apr. 2, 2013

(54) AIR-OIL SEPARATOR FOR EXTRACTING OIL FROM ENGINE BLOWBY GAS

(75) Inventors: Thomas A. Spix, Rochester Hills, MI (US); Alan E. Rice, New Baltimore, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 97 days.

(21) Appl. No.: 13/177,085

(22) Filed: Jul. 6, 2011

(65) Prior Publication Data

US 2013/0008420 A1 Jan. 10, 2013

(51) Int. Cl.
*F02M 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 4,090,477 | A * | 5/1978 | Gockel | 123/406.11 |
| 5,027,784 | A * | 7/1991 | Osawa et al. | 123/572 |
| 6,290,738 | B1 * | 9/2001 | Holm | 55/309 |
| 7,775,198 | B2 * | 8/2010 | Shieh | 123/574 |
| 8,181,634 | B2 * | 5/2012 | Spix et al. | 123/572 |
| 2002/0078936 | A1 * | 6/2002 | Shureb | 123/572 |
| 2011/0083651 | A1 * | 4/2011 | Mordukhovich et al. | 123/573 |

* cited by examiner

*Primary Examiner* — M. McMahon
(74) *Attorney, Agent, or Firm* — Quinn Law Group, PLLC

(57) ABSTRACT

An engine assembly includes an engine and an intake assembly. The engine defines a combustion chamber and a crankcase, and the intake assembly includes an intake manifold in fluid communication with the combustion chamber. An air-oil separator is provided with the engine and defines a separator volume, an inlet and an outlet, where each of the inlet and outlet are in fluid communication with the separator volume. The inlet of the air-oil separator is provided in fluid communication with the crankcase, and the outlet of the air-oil separator is provided in fluid communication with the intake manifold. The air-oil separator further includes an interior surface that abuts and surrounds the separator volume, and the interior surface has a surface roughness ($R_A$) of greater than about 75 microns.

20 Claims, 1 Drawing Sheet

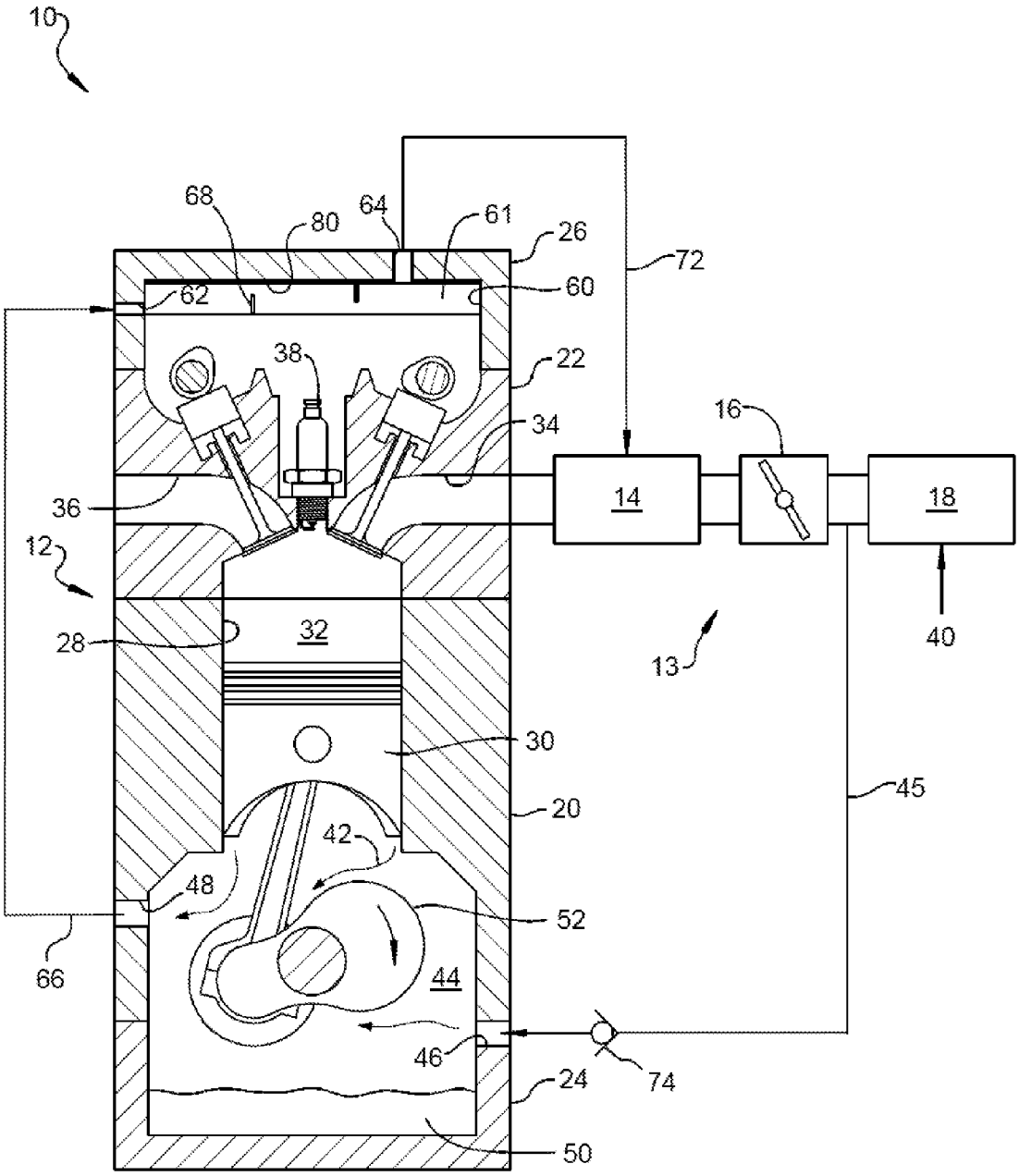
10
68
80
64
61
26
72
62
60
38
22
16
34
14
18
36
12
32
40
28
13
30
45
20
42
48
52
66
44
46
74
24
50

AIR-OIL SEPARATOR FOR EXTRACTING OIL FROM ENGINE BLOWBY GAS

TECHNICAL FIELD

The present invention relates generally to air-oil separators that may be used to extract oil from engine blowby gasses.

BACKGROUND

During engine operation, combustion gas may leak between the cylinder and the corresponding piston rings, and into the engine crankcase. The leaked combustion gas is referred to as blowby gas, and typically includes intake air, unburned fuel, exhaust gas, oil mist, and/or water vapor. In an effort to ventilate the crankcase and re-circulate the blowby gas to the intake side of the engine, a positive crankcase ventilation (PCV) system may be used.

SUMMARY

An engine assembly includes an engine and an intake assembly. The engine defines a combustion chamber and a crankcase, and the intake assembly includes an intake manifold in fluid communication with the combustion chamber. An air-oil separator may be provided with the engine and may define a separator volume, an inlet and an outlet, wherein each of the inlet and outlet are in fluid communication with the separator volume.

The inlet of the air-oil separator may be provided in fluid communication with the crankcase, and the outlet of the air-oil separator may be provided in fluid communication with the intake manifold. The air-oil separator further includes an interior surface that abuts and surrounds the separator volume, and the interior surface has a surface roughness ($R_A$) of greater than about 75 microns. In another embodiment, the interior surface may have a surface roughness ($R_A$) of greater than about 125 microns. The air-oil separator may further include at least one baffle that may extend from the interior surface of the separator into the separator volume. The baffle may likewise have a surface roughness ($R_A$) of greater than about 75 microns.

The engine may further include an engine block, a cylinder head, an oil pan, and a cylinder head cover, and the air-oil separator may be disposed within a volume partially defined by the cylinder head and cylinder head cover.

The intake assembly may include a throttle in communication with the intake manifold. The throttle may be configured to selectively control air flow into the intake manifold. Additionally, the intake assembly may include an air cleaner in fluid communication with and located upstream of the throttle.

To provide fresh air to the crankcase, a breather tube may be fluidly coupled between the intake assembly and the crankcase, wherein the breather tube may be operative to allow air to pass from the intake assembly into the crankcase. The breather tube may include a check valve that is operative to restrict air from passing from the crankcase into the intake assembly.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 1 is a schematic illustration of an engine assembly including an air-oil separator.

DETAILED DESCRIPTION

Referring to the drawings, wherein like reference numerals are used to identify like or identical components in the various views, FIG. 1 schematically illustrates an engine assembly 10 that may include an engine 12, and an intake assembly 13. The intake assembly 13 may include, for example, an intake manifold 14, a throttle 16, and air filter 18, with the throttle 16 being configured to selectively control air flow between the air filter 18 and the intake manifold 14. The engine 12 may include an engine block 20, a cylinder head 22, an oil pan 24, and an engine cylinder head cover 26. The engine block 20 may define a plurality of cylinder bores 28 (one of which is shown), with each cylinder bore 28 having a reciprocating piston 30 disposed therein. The plurality of cylinder bores 28 may be arranged in any suitable manner, such as, without limitation, a V-engine arrangement, an inline engine arrangement, and a horizontally opposed engine arrangement, as well as using both overhead cam and cam-in-block configurations.

The cylinder head 22 and engine block 20 and reciprocating piston 30 may cooperate to define a combustion chamber 32 for each respective cylinder bore 28. Additionally, the cylinder head 22 may provide one or more intake passages 34 and exhaust passages 36 that are in selective fluid communication with a combustion chamber 32. The intake passage 34 may be used to deliver an air/fuel mixture to the combustion chamber 32 from the intake manifold 14. Following combustion of the air/fuel mixture (such as when ignited by a spark from a spark plug 38), the exhaust passage 36 may carry exhaust gasses out of the combustion chamber 32.

During engine operation, an intake stroke of the piston 30 may draw intake air 40 through the air filter 18, throttle 16, intake manifold 14 and intake passage 34 and into the combustion chamber 32. During the power stroke of the piston 30, following the ignition of the air/fuel mixture, a portion of the combustion gas may pass between the piston 30 and the engine block 20 (i.e., blowby gas 42) and into the crankcase 44 (the crankcase 44 being generally defined by the oil pan 24 and engine block 20). Because the blowby gas 42 includes an amount of un-burnt fuel and products of combustion, it may be desirable to avoid having these gasses accumulate within the crankcase 44. Accordingly, intake air 40 (following filtration via the air filter 18) may be provided via a breather tube 45 coupled with the crankcase inlet port 46 to purge the blowby gas 42 from the crankcase 44. The intake air 40 and blowby gas 42 within the crankcase 44 may then be exhausted via a crankcase outlet port 48.

Due to engine vibrations, motion of the vehicle, the reciprocal motion of the piston 30, and/or the rotating motion of the crankshaft 52, oil 50 maintained within the crankcase 44 may be splashed, foamed, atomized, misted and/or sprayed within the entire volume of the crankcase 44. This atomized/particulated oil 50 may then be drawn out of the crankcase 44 via the crankcase outlet port 48 along with the intake air 40 and blowby gas 42. To prevent this oil from being drawn into the intake manifold 14 and back into the combustion chamber 32, the vented blowby gas 42 may be passed through an air-oil separator 60, which may be specially configured to separate and remove the oil 50 from the flowing gas. The air-oil separator 60 may define a separator volume 61, and may further define an inlet 62, and at least one outlet 64 that are each in fluid communication with the separator volume 61. The air-oil separator 60 may be located proximate or within the engine 12, such as, for example, within the cylinder head cover 26. In an embodiment, the air-oil separator 60 may comprise a cast aluminum or injection molded component, and may be disposed within a volume defined by the cylinder head cover 26. In another embodiment, the air-oil separator 60 may be a fully integrated portion of the cylinder head cover 26. In still another embodiment, the air-oil separator may be located apart from the cylinder head cover 26, such as within the crankcase 44, within the cylinder head 22, or external to the engine.

The inlet 62 to the air-oil separator 60 may be in fluid communication with the crankcase outlet port 48, such as through a suitable channel or tube 66. The channel or tube 66 may be, for example, a bore or channel within the engine 12, or may be, for example, a heat resistant tube that extends between the crankcase 44 and separator inlet 62. The one or more outlets 64 may be in fluid communication with the air intake assembly 13, to allow the blowby gas 42 of the crankcase 44 to re-enter the engine 12 via the intake manifold 14.

The air-oil separator 60 may include one or more drains (not shown) that may allow oil that is extracted from the passing air to flow back into the crankcase 44. The separator 60 may further include one or more upstanding baffles (e.g., baffle 68) or fins that may aid in separating the oil from the air, such as through flow redirection, or by creating a varying pressure along the flow path. As such, the inertia of the particulated oil may cause the oil to collide with one of the baffles 68 or walls of the separator 60. Once in contact with the wall, the surface tension of the oil may cause it to cling to the wall, and may subsequently run off (via gravity) toward a drain. While the air-oil separator 60 schematically illustrated in FIG. 1 as having only a single chamber, in practice, the separator 60 may include a plurality of chambers that may be joined by various flow-restricting and/or flow expanding features.

During operation, the engine 12 may generate a vacuum pressure in the intake manifold 14 when the throttle 16 partially blocks the intake air flow 40. This vacuum pressure may draw the blowby gas 42 from the crankcase 44 through the air-oil separator 60, and into the intake manifold 14. The intake manifold 14 may be coupled with the outlet port 64 of the separator 60 through a corresponding vent line 72. To prevent the blowby gas 42 from directly entering the air intake system, such as during wide open throttle conditions where no significant pressure gradient exists across the throttle 16, a check valve 74 may be provided in line with the breather tube 45.

One or more nozzles or valves (not shown) may also be provided along the vent line 72, and may used to provide generally constant flow under various engine operating conditions. As may be appreciated, this system may be adapted for use in various automotive engines, such as turbocharged, supercharged, gasoline, and/or diesel engines. Accordingly various valve configurations and/or outlet ports 64 or venting arrangements may be used to ensure that a generally constant air flow passes through the separator 60.

While a large pressure drop across the air-oil separator 60 may be beneficial in promoting effective air-oil separation, this may not be feasible in certain engine designs due to a potentially limited amount of vacuum pressure at the intake manifold 14. As such, it may be desirable to maintain the total pressure drop across the separator 60 to less than about 100 Pascals. As used herein, the pressure drop may be calculated as the difference between the absolute pressure of the gas entering the separator 60 via the inlet 62 and the absolute pressure of the gas leaving through the outlet 64.

To increase the efficiency of the separator 60 while minimizing the pressure gradient across the separator 60, the inner surface 80 of the air-oil separator 60 (i.e., the surfaces surrounding/facing/abutting the separator volume 61 and configured to contact the blowby gas 42) may be textured with a coarse surface finish. For example, a surface roughness ($R_A$) of greater than about 75-125 microns may be provided on all inner surfaces 80 to promote the efficient separation of particulated oil from the flowing blowby gas. As known in the art, roughness ($R_A$) is an arithmetic average of the measured absolute surface amplitudes from a calculated mean surface amplitude, over a statistical sample of amplitudes. In one configuration, all surfaces 80 abutting the separator volume 61, including the outward facing surfaces of any provided baffles 68, may be textured with a surface roughness ($R_A$) of greater than about 75-125 microns. In another configuration, only a subset of the surfaces 80 abutting the separator volume 61 may be textured with a surface roughness ($R_A$) of greater than about 75-125 microns.

While it is typically desirable to maintain a smooth surface finish (e.g. less than about 10 microns) to promote efficient, laminar airflow, by texturing the interior surfaces 80 of the separator volume 61, the efficiency of the air-oil separator 60 may be improved as a result of the increased surface area of the walls, the increased surface turbulence created in the boundary-layer gas flow, and/or the increased number of nucleation sites for the airborne and/or particulated oil to adhere to. For example, experimental testing data has shown approximately a 20% improvement in separating efficiency when the surface roughness ($R_A$) was increased from less than about 10 microns (i.e., smooth) to approximately 100 microns (i.e., rough).

While the best modes for carrying out the invention have been described in detail, those familiar with the art to which this invention relates will recognize various alternative designs and embodiments for practicing the invention within the scope of the appended claims. All directional references (e.g., upper, lower, upward, downward, left, right, leftward, rightward, above, below, vertical, and horizontal) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not as limiting.

The invention claimed is:

1. An engine assembly comprising:

an engine defining a combustion chamber and a crankcase;

an intake assembly including an intake manifold, the intake manifold being in fluid communication with the combustion chamber; and an air-oil separator defining a separator volume and further defining an inlet and outlet in fluid communication with the separator volume, the inlet of the air-oil separator being in fluid communication with the crankcase, and the outlet of the air-oil separator being in fluid communication with the intake manifold; and wherein the air-oil separator includes an interior surface that abuts and surrounds the separator volume; and wherein the interior surface has a surface roughness ($R_A$) of greater than about 75 microns.

2. The engine assembly of claim 1, wherein the engine includes an engine block, a cylinder head, an oil pan, and a cylinder head cover; and wherein the air-oil separator is disposed within a volume partially defined by the cylinder head and cylinder head cover.

3. The engine assembly of claim 1, wherein the intake assembly includes a throttle in communication with the intake manifold, the throttle configured to selectively control air flow into the intake manifold.

4. The engine assembly of claim 3, wherein the intake assembly includes an air cleaner in fluid communication with and located upstream of the throttle.

5. The engine assembly of claim 1, wherein a breather tube may be fluidly coupled with the intake assembly and with the crankcase, the breather tube operative to allow air to pass from the intake assembly into the crankcase.

6. The engine assembly of claim 5, wherein the breather tube includes a check valve operative to restrict air from passing from the crankcase into the intake assembly.

7. The engine assembly of claim 1, wherein the air-oil separator includes a baffle extending from the interior surface into the separator volume.

8. The engine assembly of claim 7, wherein the baffle has a surface roughness ($R_A$) of greater than about 75 microns.

9. The engine assembly of claim 1, wherein the interior surface has a surface roughness ($R_A$) of greater than about 125 microns.

10. A method of separating oil from engine blowby gas comprising:

venting blowby gas from the crankcase of an engine and into an air-oil separator;

flowing the blowby gas through a separator volume defined by the air-oil separator, the air-oil separator having an interior surface abutting and surrounding the separator volume; and venting the blowby gas from the separator volume into an intake manifold of the engine; and wherein the interior surface of the air-oil separator has a surface roughness ($R_A$) of greater than about 75 microns to promote the efficient separation of particulated oil from the flowing blowby gas.

11. The method of claim 10, further comprising providing fresh air to the crankcase.

12. The method of claim 10, wherein flowing the blowby gas through a separator volume includes redirecting the air around a baffle extending from the interior surface into the separator volume.

13. The method of claim 12, wherein the baffle has a surface roughness ($R_A$) of greater than about 75 microns.

14. The method of claim 10, the engine includes an engine block, a cylinder head, an oil pan, and a cylinder head cover; and wherein the air-oil separator is disposed within a volume partially defined by the cylinder head and cylinder head cover.

15. The method of claim 10, wherein the interior surface of the air-oil separator has a surface roughness ($R_A$) of greater than about 125 microns.

16. An engine assembly comprising:

an engine including an engine block, a cylinder head, an oil pan, and a cylinder head cover, the engine block and oil pan partially defining a crankcase;

an intake assembly including an intake manifold, the intake manifold being in fluid communication with the combustion chamber; and an air-oil separator disposed within a volume partially defined by the cylinder head and cylinder head cover, the air-oil separator defining a separator volume and further defining an inlet and outlet in fluid communication with the separator volume, the inlet of the air-oil separator being in fluid communication with the crankcase, and the outlet of the air-oil separator being in fluid communication with the intake manifold; and wherein the air-oil separator includes an interior surface that abuts and surrounds the separator volume; and wherein the interior surface has a surface roughness ($R_A$) of greater than about 75 microns.

17. The engine assembly of claim 16, wherein a breather tube may be fluidly coupled with the intake assembly and with the crankcase, the breather tube operative to allow air to pass from the intake assembly into the crankcase.

18. The engine assembly of claim 17, wherein the breather tube includes a check valve operative to restrict air from passing from the crankcase into the intake assembly.

19. The engine assembly of claim 16, wherein the air-oil separator includes a baffle extending from the interior surface into the separator volume.

20. The engine assembly of claim 19, wherein the baffle has a surface roughness ($R_A$) of greater than about 75 microns.

* * * * *